United States Patent [19]

Bunger

[11] 4,031,795

[45] June 28, 1977

[54] TONE SIGNAL MODULATION SYSTEM

[75] Inventor: David A. Bunger, Cincinnati, Ohio

[73] Assignee: D. H. Baldwin Company, Cincinnati, Ohio

[22] Filed: June 20, 1975

[21] Appl. No.: 588,627

[52] U.S. Cl. ..... 84/1.25; 84/1.01; 84/1.24

[51] Int. Cl.[2] ..... G10H 1/02

[58] Field of Search ..... 84/1.01, 1.24, 1.25, 84/DIG. 4

[56] References Cited

UNITED STATES PATENTS

| | | | |
|---|---|---|---|
| 2,835,814 | 5/1958 | Dorf | 84/1.25 |
| 3,229,019 | 1/1966 | Peterson | 84/1.24 X |
| 3,538,234 | 11/1970 | Peterson | 84/1.24 |
| 3,644,657 | 2/1972 | Miller | 84/1.25 |
| 3,749,837 | 7/1973 | Doughty | 84/1.25 X |
| 3,866,505 | 2/1975 | Adachi | 84/1.25 X |
| 3,886,835 | 6/1975 | Peterson | 84/1.25 X |
| 4,000,676 | 1/1977 | Love | 84/1.25 |

*Primary Examiner*—Ulysses Weldon
*Attorney, Agent, or Firm*—Kirkland & Ellis

[57] ABSTRACT

Modulation systems for electrical signals representing music in which synchronous vibrato and tremolo modulations are applied to a flute signal in one channel, the vibrator being produced by a bucket brigade modulator and the tremolo by a balanced modulator in cascade with the bucket brigade modulator, and in which in a second channel tones other than flute tones, and pedal tones, are separately treated to have independent vibratos, and in which balanced modulators for modifying the amplitude of the tone signals are concurrently controlled by a common expression voltage. In one modification flute signals are vibrato modulated in opposed phases, and passed via diverse filters to a common tremolo modulator. Provision is made for combining the inputs of the channels, the outputs of which are electroacoustically transduced by separated loudspeakers. Provision is made for slowly varying the frequency of a sub-sonic modulating oscillator, which is either turned off, or operates at about 1 or about 6 Hz., in proceeding from any one of these three values to any other, the rate of variation being such as to simulate the rate which occurs when the modulations are produced by rotation of a mechanical device such as a rotating loudspeaker.

11 Claims, 3 Drawing Figures

TONE SIGNAL MODULATION SYSTEM

BACKGROUND OF THE INVENTION

It is common in transducing electronic music to employ a rotating loudspeaker, or a stationary loudspeaker and a moving horn or reflector, to produce a rotating acoustic radiation pattern, the rotation rate being about 6 or 7 rps., or less, and the motion being such as to develop Doppler variations in frequency. Such devices provide pleasing effects, the tones being both frequency and amplitude modulated. In such systems, it is common to provide variations in frequency of rotation. However, the cost of a mechanical system is considerable in relation to the cost of a common electronic organ.

It is an object of the present invention to provide a wholly electronic system for simulating the audio effects produced by a mechanically rotating acoustic source which is designed to produce Doppler variations in frequency.

It is another object of the invention to provide a system in which (1) flute and (2) other output tones, of an electronic, organ, are independently modulated in frequency and amplitude and radiated via separate spatially separated loudspeakers.

The system employs cascaded frequency modulators and amplitude modulators, the latter controlling expression and also introducing tremolo.

SUMMARY OF THE INVENTION

An electric organ system, in which diverse tone source outputs are diversely frequency modulated by means of analogue shift registers, in separate channels, the content of one of the channels being amplitude modulated at the same frequency as its frequency modulation, the one of the channels containing selectively only flute tone signals or a combination of flute and other tone signals, and radiating the modulated tone content of the channels via spatially separated loudspeakers.

DESCRIPTION OF THE INVENTION

Figure 1:
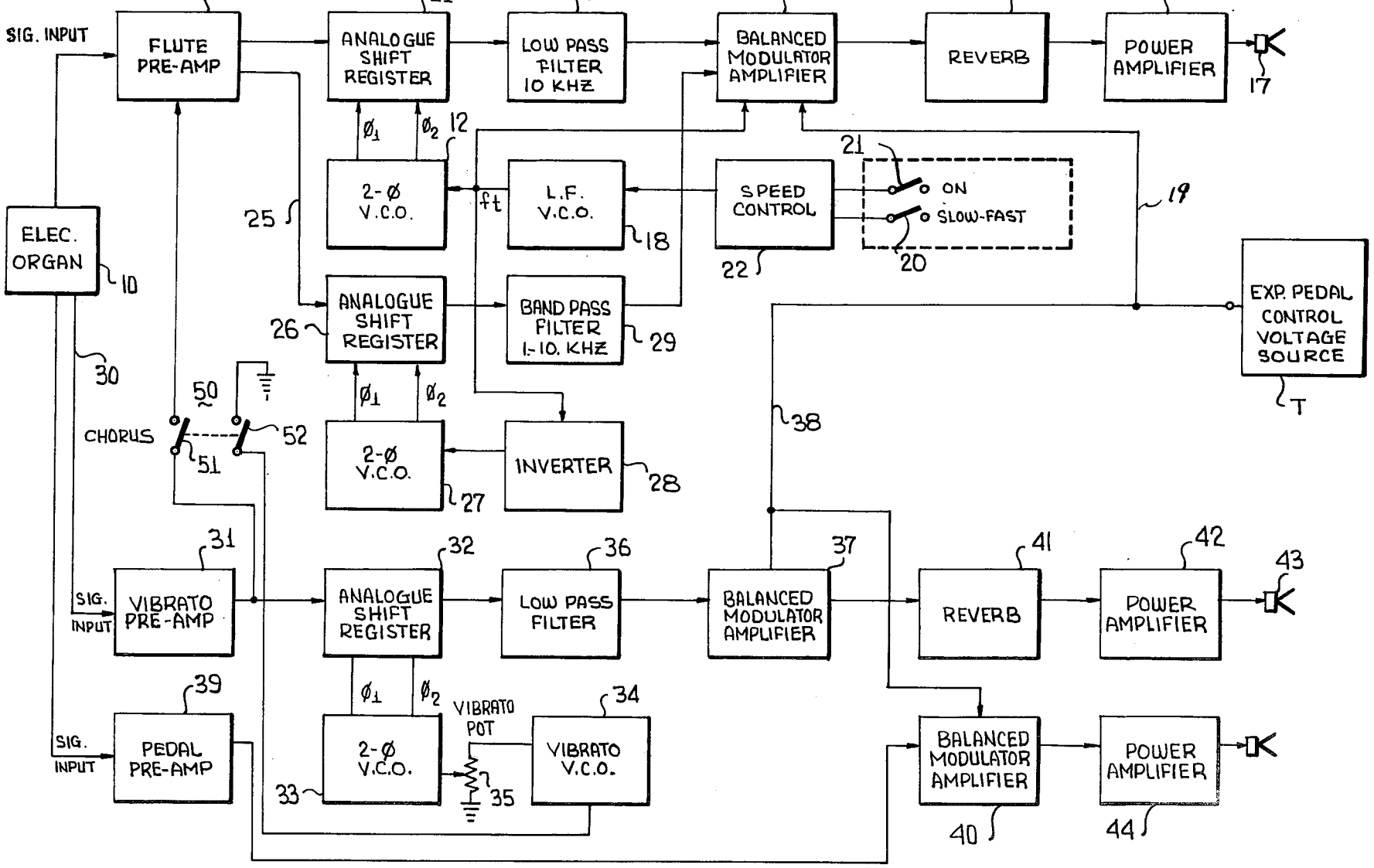
FIG. 1 is a block diagram of a first embodiment of the invention.

Referring now particularly to FIG. 1 of the drawings, the flute tones of an organ 10 are applied via pre-amplifier 10*a* to a first bucket brigade line or analogue shift register 11. The character and function of register 11 is generally well understood. It is driven in two phases $\phi_1$, $\phi_2$by a 90 KHz. clock 12, which is a voltage controlled oscillator (VCO). The register provides a nominal delay of 1.03 ms. If the VCO frequency is modulated at a slow rate, the output of the shift register will be delay modulated, delay time being inversely proportional to clock frequency. This is equivalent to producing a varying frequency shift since read-out is at times a different rate than read-in. It is known that a bucket brigade delay line provides equal percentage frequency shifts for all frequencies of input. If the rate of change of delay with respect to time is varied in a sinusoidal manner, in the present case either at a 6.4 Hz. or a 1 Hz. rate, the output of the delay line will be frequency modulated at the same rates. At the 6.4 Hz. modulation rate frequency modulation is approximately 2.5% and at 1 Hz. about 9.5%.

The flute audio signal at the output of the shift register 11 contains the clock pulses. These are removed by low pass filter 13, leaving the flute signal, and the latter is applied to a balanced modulator amplifier 14, which introduces amplitude modulation. The output of balanced modulator amplifier 14 is passed through a conventional reverberator 15 and power amplifier 16 to a loudspeaker 17.

The frequency of VCO 12 is controlled by a low frequency voltage controlled oscillator 18, providing either 6.4 Hz. or 1 Hz. or zero output, the latter output results in no frequency modulation of clock 12, so that shift register 11 introduces a fixed delay of 1.03 ms.

The output of oscillator 18 is applied to balanced modulator 14, and introduces amplitude modulation. The balanced character of modulator amplifier 14 assures that the modulation frequency will be suppressed and the signal passed through.

The balanced modulator 14 is also subject to a dc voltage, via line 19, from an expression pedal controlled potentiometer, so that the volume of acoustic output can be controlled, as is conventional, by an expression shoe.

The oscillator 18 is controlled in frequency by switch 20, and may be turned on or off by switch 21, the switches 20, 21 setting a control voltage to oscillator 18, via speed control circuit 22, i.e., operation of the switches causes speed control 22 to provide to oscillator 18 the requisite control voltage.

The output of pre-amplifier 10*a* is applied via lead 25 to a second analogue shift register 26, of the bucket brigade type, driven by a clock in the form of a two phase VCO 27. The latter is driven by low frequency VCO 18 via phase inverter 28. The shift registers 11 and 26 are driven by different clocks, which deviate in frequency in opposed phases. At the 6.4 Hz. modulation rate, frequency modulation is approximately 4.0% and at 1 Hz. about 0.6%.

The output of shift register 26 is applied to balanced modulator 14 as an input signal via a band pass filter 29, having a band pass of 1–10 KHz.

The utilization of two frequency modulated versions of the flute signal produces a more realistic tremolo effect than is true for a single version. The diverse filters employed, i.e., low pass filter 13, cutting off at 10 KHz., and band pass filter 29, having a pass band of 1–10 KHz., implies that for frequency below 1 KHz. shift register 11 will provide the predominant audio signal to modulator 14, while for frequencies above 1 KHz. shift register 26 will provide an additional audio signal to modulator 14. These are identically amplitude modulated but diversely frequency modulated, but in a controlled and not a random fashion. The summing of outputs of shift registers 11 and 26, in addition to providing dual frequency modulated outputs, causes a complex pattern of amplitude modulation which is independent of the amplitude modulation imparted to the signal by balanced modulator 14.

The output of organ 10, apart from flute signals, proceeds via line 30 to a pre-amplifier 31. The latter signal is applied to a third analogue shift register 32 of the bucket brigade type. The latter is driven by a clock 33 in the form of a two phase VCO, which is in turn frequency modulated by a low frequency oscillator 34, via a potentiometer 35 which controls the frequency deviation of the clock 33. The output of shift register 32 is filtered by low pass filter 36, to remove clock pulse frequencies, and applied to balanced modulator 37. The latter is the same circuit as modulator amplifier 14, except in that no amplitude modulation is applied, but only expression control voltage via lead 38, so that flutes and other tones will sound at the same audio levels.

The output of a pedal tone pre-amplifier 39 is applied to balanced modulator amplifier 40 controlled from lead 38. The output of modulator amplifier 37 is applied via reverberator 41 and power amplifier 42 to loudspeaker 43, while the pedal signals are amplified by power amplifier 44 to loudspeaker 45.

A switch 50, including ganged contacts 51 and 52, serves to control the VCO 34 to a frequency of about 5.0 Hz. when the contacts 52 are closed, and to about 6.4 Hz. when open and to convey signals from pre-amplifier 31 to a pre-amplifier 10*a* when contacts 51 are closed.

With switch 50 in closed condition, then, the shift registers 11 and 26 and the amplitude modulator 14 serve to modulate all tone signals of the organ, as called for by appropriate stops. At the same time tone signals other than flutes are vibrato modulated, and heard via loudspeaker 43, and are frequency modulated at a different rate with respect to those signals provided by pre-amplifier 10*a*, but are not amplitude modulated.

The net response of the organ represents an augmented chorus effect, the signal input via lead 30 being subject to many diverse effects, i.e., to two out-of-phase frequency modulations in channel A, to amplitude modulation in channel A, to diverse filtering in channel A, to frequency modulation in channel B, and to radiation via spatially separated loudspeakers for channels A and B.

Figure 2:
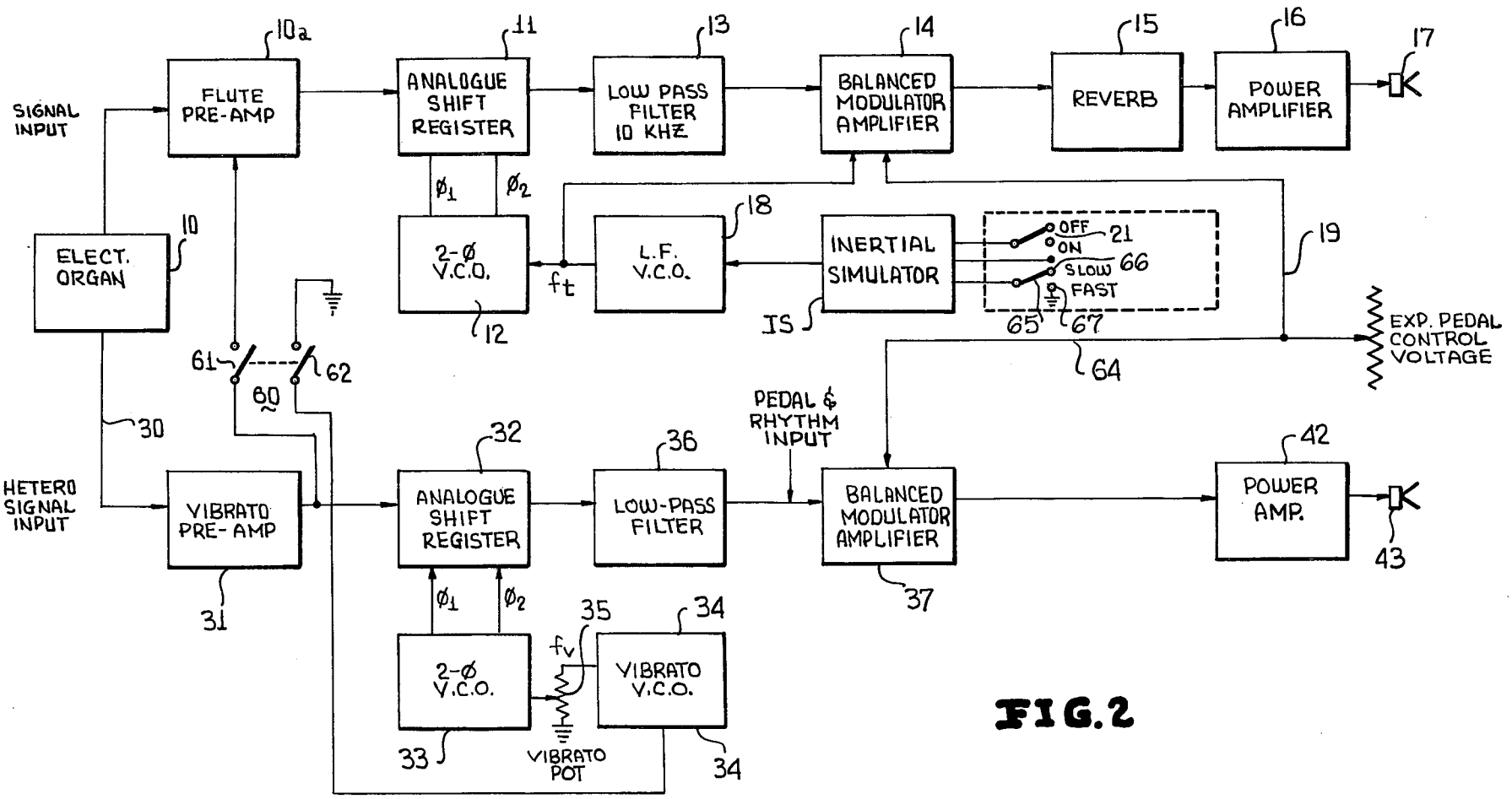
FIG. 2 is a block diagram of a second embodiment of the invenion.

FIG. 2 represents a simplified version of the system of FIG. 1. Corresponding circuit elements are identified by corresponding reference numerals in FIGS. 1 and 2. In FIG. 2 appears a switch 60, having contacts 61 and 62. When contacts 62 are closed VCO 34 is at 5.0 Hz. When open, VCO 34 provides modulating signal at 6.4 Hz. When contact 61 is closed the signal output of the organ 10, exclusive of flute tones, is applied to the input of shift register 11, via lead 63.

Pedal frequencies are applied as signal input to modulator amplifier 37, which is employed solely to control amplitude in response to dc voltage provided via lead 64 from expression pedal control source P.

The VCO 18 is, in FIG. 2, controlled by a voltage which varies slowly. For example, if switch contact 65 is moved from its slow contact 66 to its fast contact 67, the frequency output of VCO 18 is desired to change slowly from 1 to 6.4 Hz., and vice versa. The rate of increase of frequency output of VCO 18 is controlled by inertial simulator 68 which is designed to introduce a gradual change of voltage simulating that which occurs when an attempt is made to modify the speed of a mechanically rotating device.

The hetero signal may, if desired, include flute signals.

In the system of FIG. 2 is provided an inertial simulator IS, which effects controlled slow variations of frequency of VCO 18.

Figure 3:
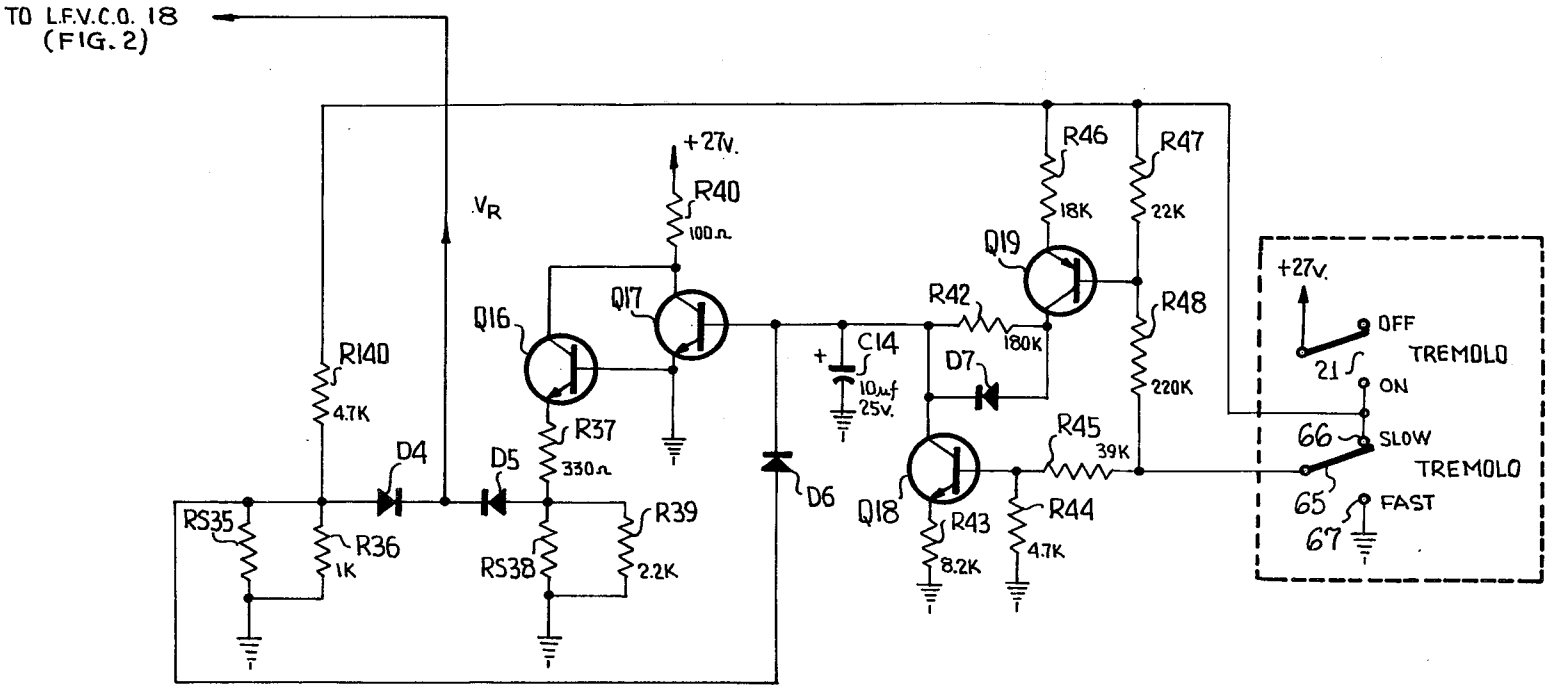
FIG. 3 is a schematic circuit diagram of a circuit for slowly varying the frequency of a modulating oscillator, responsive to operation of a switch, in the systems of FIGS. 1 or 2.

Refering to FIG. 3 a dc voltage $V_r$ is developed at the junction of diodes $D_4$ and $D_5$ which controls the frequency of the low frequency voltage controlled oscillator (VCO). The purpose of the inertial simulator circuit is to provide three voltages which will cause the VCO 18 to simulate mechanical rotor off, slow and fast conditions and to cause the voltage to change from one value to the next in a controlled manner, causing the frequency to change in such a way as to simulate the inertial characteristics of a rotating speaker during speed-up and slow-down. This effect is inherent in a rotating loudspeaker.

When the tremolo switch is "off" transistors Q1g, Q17 and Q16 will be off and no voltage will be developed at the anode of diode D5, and no voltage will appear at the anode of diode D4. Thus, O volts appears at the junction of D4 and D5 and the VCO 18 will not oscillate, simulating the tremolo "off" conditions.

With the tremolo switch 21 "on" "slow" transistor Q19 will remain off; however, +27 volts is applied to resistor R 140. Resistor RS 35 is selected for a value of voltage at the anode of diode D4 which will cause the VCO 18 to oscillate at 1 Hz. This voltage is also applied to the base of transistor Q17 via diode D6 and causes a voltage to appear at the anode of diode D5, which is three diode drops below the voltage appearing at the anode of diode D4. Thus, diode D5 is reversed biased. The purpose of diode D6 is to reduce any time delay when switching from "slow" to "fast". This is accomplished by the fact that capacitor C14 does not have to change from ground but from a diode drop below the voltage appearing at the anode of diode D4, thus reducing the time necessary for the voltage at the anode of D5 to exceed the voltage at the anode of D4, causing the frequency of the VCO 18 to start increasing.

With the tremolo switch "on" and "fast", transistor Q19 turns on, charging capacitor C14 via R46 and D7. The rate of charge is determined by the value of R46. The time necessary for C14 to become fully charged is approximately 6 seconds. During this charging time the rate of the VCO is increasing.

The voltage on C14 is applied via transistors Q17 and Q16 to the anode of diode D5. Resistor R*s*38 is selected by a value of voltage at the anode of D5 which will cause the VCO 18 to oscillate at 6.4 Hz. Diode D4 is now reversed biased, thus the load of resistors R140, R36 and R*s*35 will not effect the voltage at the anode of diode D5. Thus, diodes D4 and D5 are used to isolate any loading or interaction between the "slow" and "fast" calibrating circuits.

When the tremolo switch is switched from "fast" to "slow" transistor Q19 again turns "off" and no voltage is supplied to capacitor C14 via diode D7. Transistor Q17 is turned on and capacitor C14 is discharged via Q18 and resistor R43 at a rate which is determined by the voltage at the base of Q18. C14 will discharge until its voltage is a diode drop below the voltage at the anode of D4 at which D6 will become forward biased, holding the voltage across C14 as previously described. The time necessary for C14 to discharge is approximately 3 seconds.

Transistors Q16 and Q17 isolate the resistor load of R37, R39 and Rs38 from capacitor C14 so the primary discharge path of C14 is via transistor Q18. When switching from tremolo "fast" to "off" transistor Q17 will not turn on. In this condition C14's primary discharge path is via R42, collector base diode of Q19, resistor R48, R45, R44 to ground. The time necessary for C14 to discharge to ground via this path is approximately 7 seconds.

What I claim is:

1. An electric organ system, comprising an electric organ having a flute signal output lead and a heterosignal output lead, means including a first analogue shift register means for modulating the frequency of said flute signal, amplitude modulation means in cascade with said analogue shift register, oscillator means providing modulating signal to said analogue first shift register means and to said amplitude modulator means, a first loudspeaker responsive to the output of said amplitude modulator means, means including a further analogue shift register for modulating the frequency of said heterosignal, said heterosignal being exclusive of said flute signal, a second loudspeaker connected in cascade with said further analogue shift register, and switch means operable for transferring signal from said heterosignal output lead to the input of said first analogue shift register means, said first and second loudspeakers being spatially separated sufficiently to represent distinct acoustic sources.

2. The combination according to claim 1, wherein said first analogue shift register means includes first and second analogue shift registers connected in parallel to said flute signal output lead, and said oscillator means comprises separate clock sources connected respectively to drive said first and second analogue shift register means, said clock sources being oscillators, and means for driving said oscillators in opposite phases.

3. The combination according to claim 2, wherein said means for driving said oscillators in opposite phases comprises a low frequency voltage-controlled oscillator and an inverter.

4. The combination according to claim 2, further comprising first and second diverse audio filters in cascade with said first and second analogue shift registers respectively, said diverse filters having diverse frequency cut-off ranges.

5. The combination according to claim 4 wherein said first diverse audio filter has a cut-off range of approximately 20 Hz to 10 KHz and said second diverse audio filter has a cut-off range of approximately 1 to 10 KHz.

6. The combination according to claim 1, wherein are provided diverse modulating frequency sources for said first analogue shift register means and said further analogue shift register.

7. The combination according to claim 1, wherein is provided means for modifying the frequency of said modulating signal.

8. The combination according to claim 1, wherein is provided a rotating speaker inertial simulator for modifying the frequency of said modulating signal.

9. The combination according to claim 1, wherein is provided means for slowly modifying the frequency of said sub-sonic oscillator at a rate simulating the rate at which a mechanically rotated loudspeaker varies.

10. In an organ system, sources of diverse frequency spectra, separate frequency modulators for diversely frequency modulating said diverse frequency spectra, means for amplitude modulating one of said spectra in synchronism with the frequency modulation of that one of said spectra, separated loudspeakers for electroacoustically separatedly transducing said spectra following modulations thereof, and switch means for selectively combining said frequency spectra at the input of one of said frequency modulators, said frequency modulators including separate analogue shift register means.

11. The combination according to claim 10, wherein one of said analogue shift register means includes two analogue shift registers having separate and independent clocks, and means for periodically varying the frequencies of said clocks in substantially opposite phases.

* * * * *

UNITED STATES PATENT OFFICE
CERTIFICATE OF CORRECTION

Patent No. 4,031,795 Dated June 28, 1977

Inventor(s) David A. Bunger

It is certified that error appears in the above-identified patent and that said Letters Patent are hereby corrected as shown below:

Abstract, line 19, after "1" insert --Hz--.

Column 1, line 24, "electronic," should read --electronic--.

Column 2, line 6, "9.5%' should read --0.5%--.

Column 3, line 60, "68" should read --IS--.

Column 4, line 1, "Refering" should read --Referring--.

Column 4, line 13, "Q1g" should read --Q19--.

Column 4, line 54, "Q19" should read --Q18--.

Column 4, line 58, after "which" insert --time--.

Column 4, line 66, "Q17" should read --Q18--.

Column 6, line 6, after "1" insert --KHz--.

Signed and Sealed this

Eighth Day of November 1977

[SEAL]

*Attest:*

RUTH C. MASON
*Attesting Officer*

LUTRELLE F. PARKER
*Acting Commissioner of Patents and Trademarks*